US006200018B1

(12) United States Patent
Dubugnon et al.

(10) Patent No.: US 6,200,018 B1
(45) Date of Patent: Mar. 13, 2001

(54) WATCH INCLUDING MEANS ALLOWING THE INTRODUCTION OF ELECTRIC CONNECTING MEANS INSIDE THE WATCH CASE

(75) Inventors: Dominique Dubugnon, Etoy; Jean-Jacques Born, Morges, both of (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/500,630

(22) Filed: Feb. 9, 2000

(30) Foreign Application Priority Data

Mar. 4, 1999 (CH) ..... 0398/99

(51) Int. Cl.[7] ..... A44L 5/00; G04B 37/00
(52) U.S. Cl. ..... 368/281; 224/168
(58) Field of Search ..... 368/10, 88, 276, 368/281, 282; 224/167–171, 174, 175, 179

(56) References Cited

U.S. PATENT DOCUMENTS 2,985,291 5/1961 Schoepe et al. ..... 206/56
5,872,744 * 2/1999 Taylor ..... 368/13
5,889,797 * 3/1999 Alamch et al. ..... 368/204

FOREIGN PATENT DOCUMENTS 0 660 204 A1 6/1995 (EP) .
2 284 149 4/1976 (FR) .
2 604 566 4/1988 (FR) .

* cited by examiner

*Primary Examiner*—Vit Miska
(74) *Attorney, Agent, or Firm*—Griffin & Szipl, P.C.

(57) ABSTRACT

A watch including a watch case (1), a wristband (2), a first and a second electric module (5, 6), respectively arranged inside and outside the watch case (1), a and electric connecting means (3) assuring an electric connection between said first and second electric modules (5, 6). According to the present invention, this watch includes introduction means (4; 44, 8; 9) allowing said electric connecting means (3) to be introduced inside the watch case (1) in a water resistant manner.

14 Claims, 5 Drawing Sheets

WATCH INCLUDING MEANS ALLOWING THE INTRODUCTION OF ELECTRIC CONNECTING MEANS INSIDE THE WATCH CASE

The present invention concerns a watch including a watch case inside which is arranged a first electric module, and a wristband attached to said watch case and with which are associated a second electric module and electric connecting means assuring an electric connection between said first and second electric modules. More particularly, the present invention concerns a watch of this type including means allowing the electric connecting means to be introduced in a fluid tight manner inside the watch case.

In the present description, <<electric connecting means>> means any conductor or set of conductors allowing an electric connection to be assured between two electric modules. Likewise, <<electric module>> means any device intended to provide or receive electric power and, possibly, to transmit or receive an electric signal.

Arranging electric modules, such as control buttons, electric power sources or electronic circuits outside a watch case is currently known. For example Swiss Patent No. CH 343 323 discloses a wristwatch provided with a first electric module arranged inside the watch case and a second electric module including an electric power source associated with the wristband of the watch and intended to supply the first electric module with power. According to this Patent, an insulated electric connection penetrating directly inside the case connects the first and second electric modules.

Alternatively, in order to assure an adequate electric connection between electric modules situated respectively, inside and outside the case of a watch, a commonly used solution consists in providing, on the connection lines between the electric modules, contacts generally situated in the vicinity of the attachment of the wristband to the watch case. The electric connection is broken down, in this case, into a first portion, situated inside the watch case, and a second portion, situated outside the watch case. This solution is particularly suited to making water resistant watches since the electric connection means do not physically penetrate inside the case.

An example of a device having these features is for example disclosed in European Patent No. EP 0 186 804. In this example, the contacts are formed by a set of separable connected contacts so that the wristband can be easily dismantled and reassembled without any risk of false contact or deterioration in the quality of the sealing of the contacts.

It will be noted however that it becomes particularly problematic to make such a device when the number of connection lines, and thereby the number of contacts, becomes significant. Indeed, the size and dimensions of the different contacts limits the number of connection lines which it is possible to connect to the watch case.

As already mentioned, it is alternatively possible to introduce the electric connecting means directly inside the watch case without making use of intermediate contacts. For this purpose, the electric connecting means can be introduced through an orifice arranged in the watch case as is described for example in the aforecited Swiss Patent No. CH 343 323. The drawback of the solution disclosed in this Patent lies in the fact that the assembly thereby formed is difficult to dismantle. In particular, in order to assure the water resistance of the watch case, it is necessary to provide a protective covering around the electric connecting means making the orifice in the watch case water resistant. This covering is thus typically driven into the orifice made in the watch case. It follows that the dismantling of the wristband and the electric connecting means is made difficult and complex. It can further be observed that another drawback of the design presented in this Swiss Patent lies in the fact that the protective covering surrounding the electric connecting means is directly subjected to mechanical stress which can lead to deterioration of the water resistance of the case in the vicinity of the orifice or may cause breakage of the electric connecting means.

One object of the present invention is thus to propose a watch of the aforementioned type in which the electric connecting means can be directly introduced inside the watch case and which do not have the drawbacks which have just been mentioned.

In particular, an object of the present invention is to allow easy assembly and dismantling of the wristband and the electric connecting means integrated in the wristband while assuring optimum sealing of the assembly.

The present invention therefore concerns a watch including a watch case in which is arranged a first electric module, and a wristband attached to said watch case and with which are associated a second electric module and electric connecting means assuring an electric connection between said first and second electric modules, characterized in that the watch includes introduction means allowing said electric connecting means to be introduced inside the watch case in a water resistant manner, these introduction means being arranged in an introduction orifice provided in said watch case and retained by mean of a pin, this watch further including sealing means assuring sealing of said introduction orifice when the introduction means are disposed therein.

Advantageous embodiments of the present invention form the subject of dependent claims.

As a result of these features, the electric connecting means can directly penetrate the interior of the watch case. The introduction means are held in position by the pin so that the assembly and dismantling of the assembly is facilitated. Indeed, since the introduction means are not driven into the introduction orifice made in the watch case, the assembly and dismantling respectively thereof is easily effected by the introduction and respectively removal of the pin. The pin retaining the introduction means can further advantageously form an articulation pin of the wristband.

The sealing means also assure optimum sealing of the watch in the vicinity of the introduction orifice.

This solution further allows total freedom as regards the particular structure of the electric connecting means. In particular, the number of connection lines no longer constitutes a limit since the introduction means are independent of the electric connecting means used.

It will further be noted that the solution according to the present invention also allows the manufacturing costs of the watch to be reduced compared to the solutions of the prior art using intermediate contacts, since the number of parts necessary to allow introduction of the electric connecting means is substantially limited.

Other features and advantages of the invention will appear more clearly upon reading the following detailed description, made with reference to the annexed drawings, given by way of non limiting examples and in which.

Figure 1:
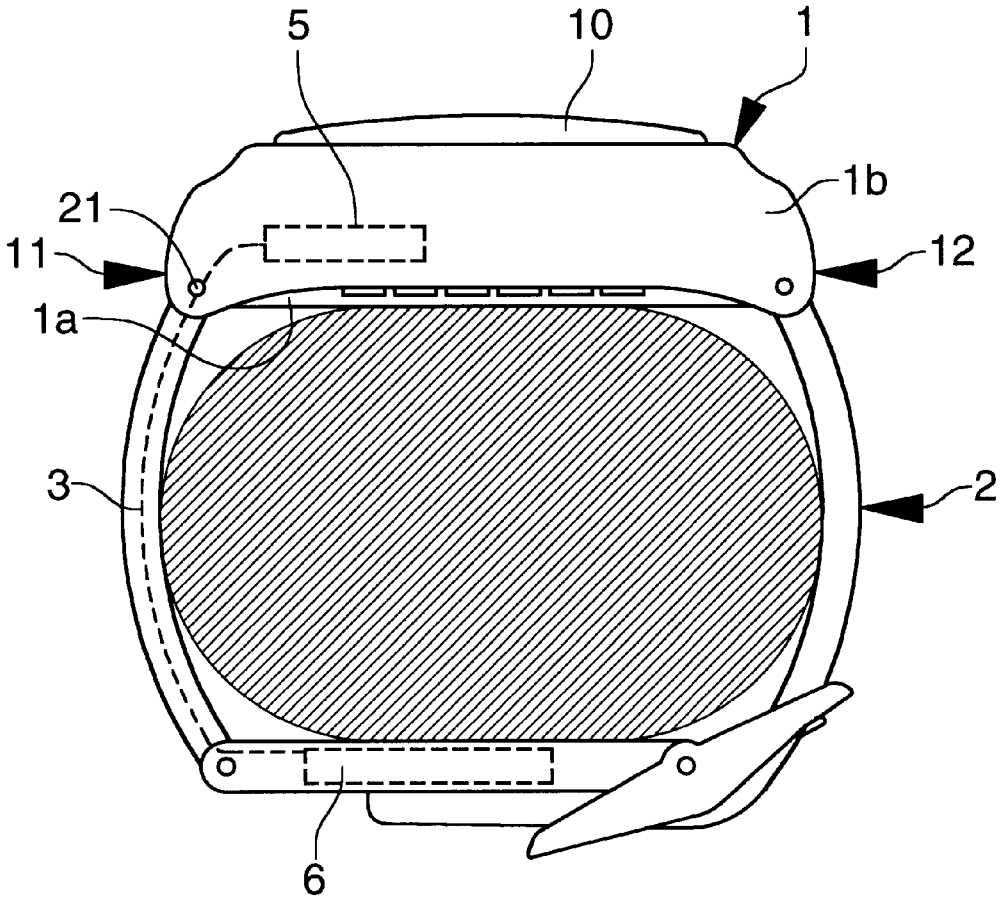
FIG. 1 is an overall view of a watch according to the present invention.

FIG. 1 illustrates a watch according to the present invention. This watch thus includes a watch case 1 and a wristband 2 attached to watch case 1, in a non limiting manner, by hinges 11 and 12. Watch case 1 further includes a back cover 1*a* and a middle part 1*b* on which is mounted a crystal 10.

Watch case 1 typically encloses a clockwork movement or alternatively a clockwork electronic circuit allowing the generation and display of time data. In the present description, the assembly, or at least a substantial part of the electric and/or electronic means arranged within watch case 1 have been generally designated by the term <<first electric module>> (reference 5 in the Figures). These electric and/or electronic means can be very diverse and varied according to whether the watch is of an electromechanical or electronic type. This watch may further have additional complications (for example a radio frequency module, a GPS module, etc.). Within the scope of the present invention, it will thus be understood that any electric/electronic device arranged within the watch case and intended to collaborate with an electric device arranged outside the watch case will be designated <<first electric module>>.

Similarly, within the scope of the present invention, the term <<second electric module>> (reference 6 in the FIGS.) generally designates an electric/electronic device arranged outside the watch case and intended to collaborate with first electric module 5 so as to supply or receive electric power and, possibly, to transmit or receive an electric signal. Typically, this second electric module 6 can include an electric power source (battery, accumulator, etc.), means for providing interface with a user (control buttons, keyboard, etc.), or any other electronic circuit intended to cooperate with first electric module 5 (memories, smartcard, etc.). This second electric module can further be associated with the watch wristband.

In order to assure an electric connection between these first and second electric modules 5 and 6, the watch forming the subject of the present invention further includes electric connecting means 3, associated in this example with watch wristband 2. Within the scope of the present invention, these electric connecting means 3 penetrate directly the interior of watch case 1, in order to be connected to first electric module 5.

Figure 2:
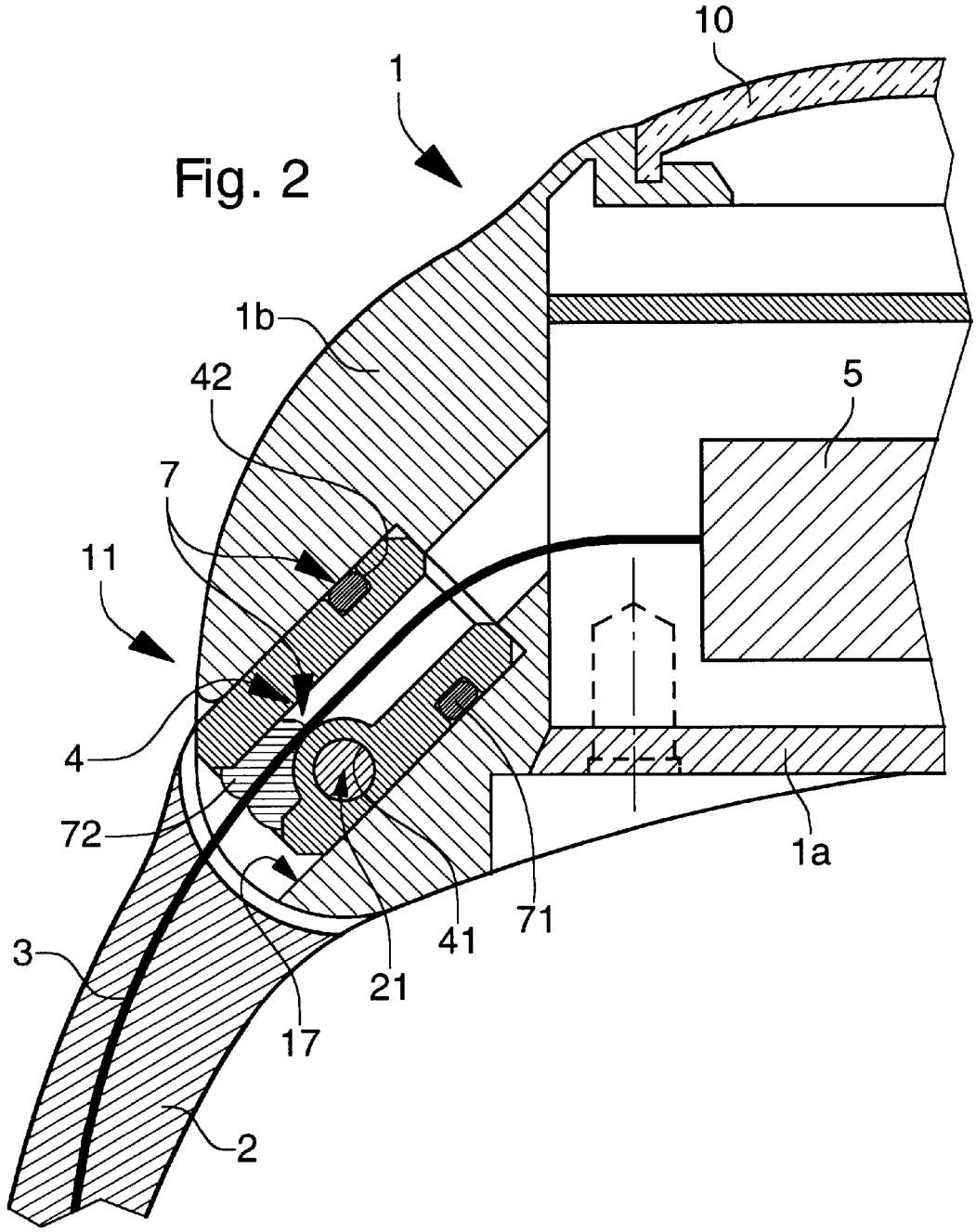
FIG. 2 is an enlarged cross-section of a portion of the watch forming a first embodiment of the present invention.
Figure 3:
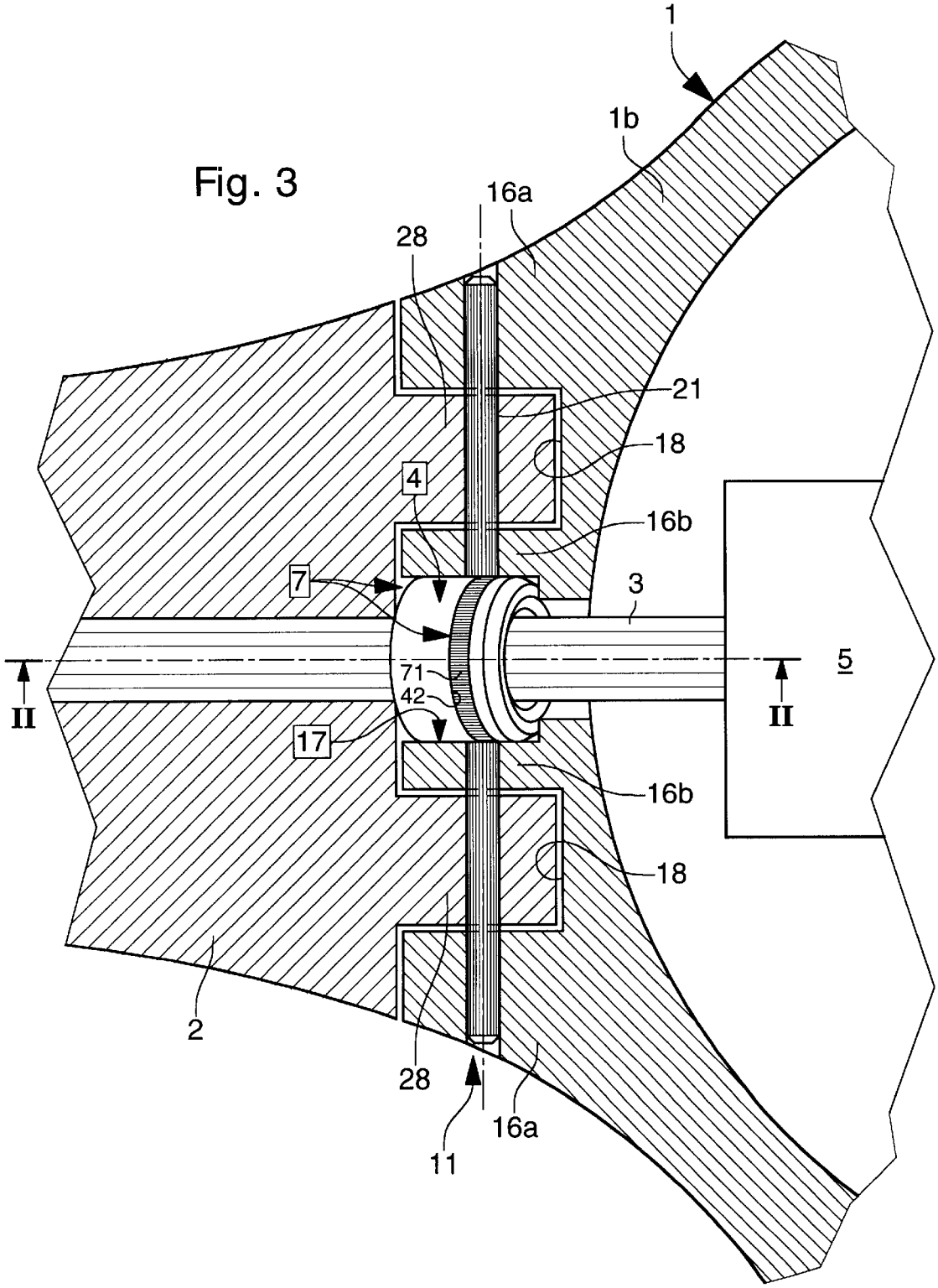
FIG. 3 is an enlarged top view of a portion of the watch illustrated in FIG. 2.

For this purpose as is illustrated in FIGS. 2 and 3 showing a first embodiment of the present invention, an introduction orifice 17 is thus arranged in middle part 1*b* of watch case 1 in the vicinity of the attachment of wristband 2, namely, in this example, in the vicinity of hinge 11.

In the embodiments shown here, electric connecting means 3 are formed of a flexible substrate supporting a plurality of conductive paths. It will be noted however, that the type and structure of these electric connecting means 3 are not determining. Indeed, it does not matter whether these electric connecting means 3 are made in the form of a set of conductive paths formed on a flexible dielectric substrate, as is the case in this example, or, alternatively, in the form of a set of independent conductors. It will thus be understood that different types of electric connecting means can be used, which constitutes a substantial advantage compared to the known devices described in the preamble part of this description, such as that disclosed in the aforecited European Patent No. EP 0 186 804.

According to a first embodiment of the present invention illustrated in FIGS. 2 and 3, in order to allow the introduction of electric connecting means 3 inside watch case 1 while assuring sealing thereof, the watch includes introduction means formed of an introduction element 4 arranged in introduction orifice 17 made in watch case 1. This introduction element 4 has in this example a substantially tubular shape allowing the passage of electric connecting means 3.

This introduction element 4 is held in its position by means of a pin 21 which in this example advantageously forms an articulation pin for hinge 11. This solution allows introduction element 4 to be arranged without having to drive the latter into introduction orifice 17. It follows that the assembly and dismantling of wristband 2 and electric connecting means 3 does not present any major difficulty, the only constraint lying in the connection of electric connecting means 3 to first electric module 5 arranged within watch case 1.

As is clear from FIG. 3, hinge 11 includes, in this non limiting example, two external portions 16*a* and two intermediate portions 16*b* integral with middle part 1*b* of watch case 1. Hinge 11 also includes two elements 28 integral with wristband 2, each element 28 being respectively engaged in a space 18 existing between a neighbouring external portion 16*a* and intermediate portion 16*b*. In this example, introduction orifice 17 in which introduction element 4 is disposed, is arranged between the two intermediate portions 16*b* of hinge 11.

Each portion 16*a* and 16*b*, and each element 28 of the hinge is pierced with a hole in which articulation pin 21 of hinge 11 is inserted. In this example. introduction element 4 is, similarly, pierced with a hole 41 allowing the passage of articulation pin 21. Alternatively, in order to retain introduction element 4, one can envisage using first and second articulation pins on either side of introduction element 4 so as to eliminate the necessity of arranging a hole in the latter.

It will further be mentioned that the watch wristband can alternatively be attached to the watch case by means of a bar fixed between horns arranged on the watch case, this bar being able to be used to assure holding of the introduction element.

In order to assure adequate sealing of watch case 1 in the vicinity of introduction orifice 17, the watch according to the present invention further includes sealing means 7 assuring sealing of introduction orifice 17. In the embodiment illustrated in FIGS. 1 to 3, these sealing means include an annular gasket or joint 71 arranged in a channel 42 arranged on an external portion of introduction element 4.

According to this first embodiment of the present invention, the watch further includes a gasket acting as a plug 72 arranged inside introduction element 4. This plug 72 can be formed by deposition of a silicon joint after assembly of electric connecting means 3. Alternatively, this plug 72 can be over-moulded around electric connecting means 3.

Figure 4:
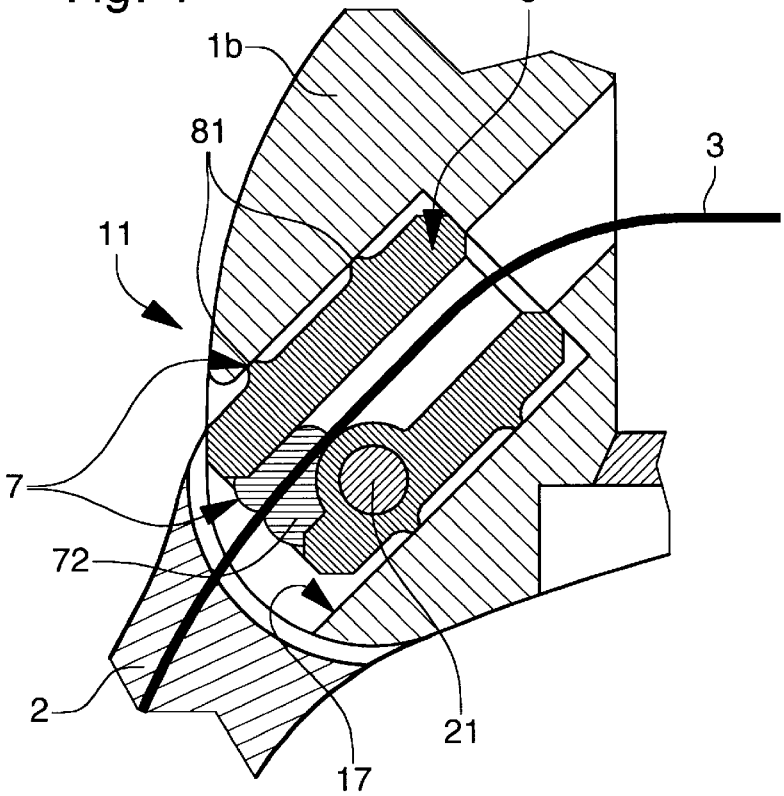
FIG. 4 is an enlarged cross-section of a watch forming a second embodiment of the present invention.

FIG. 4 shows a cross-section of a portion of a watch forming a second embodiment of the present invention. The elements common to the first embodiment already presented will not be described again and are designated by the same numerical references.

According to this second embodiment, the watch includes introduction means which differ slightly from the means used in the preceding embodiment. The introduction means are formed in this example of an introduction element 8 including, on its outer portion, at least one bulge of material 81 forming sealing means 7 for the watch. When introduction element 8 is inserted into introduction orifice 17, bulge of material 81 prevents any infiltration of liquid.

Alternatively, the bulge of material can be made on an inner portion of introduction orifice 17.

Figure 5:
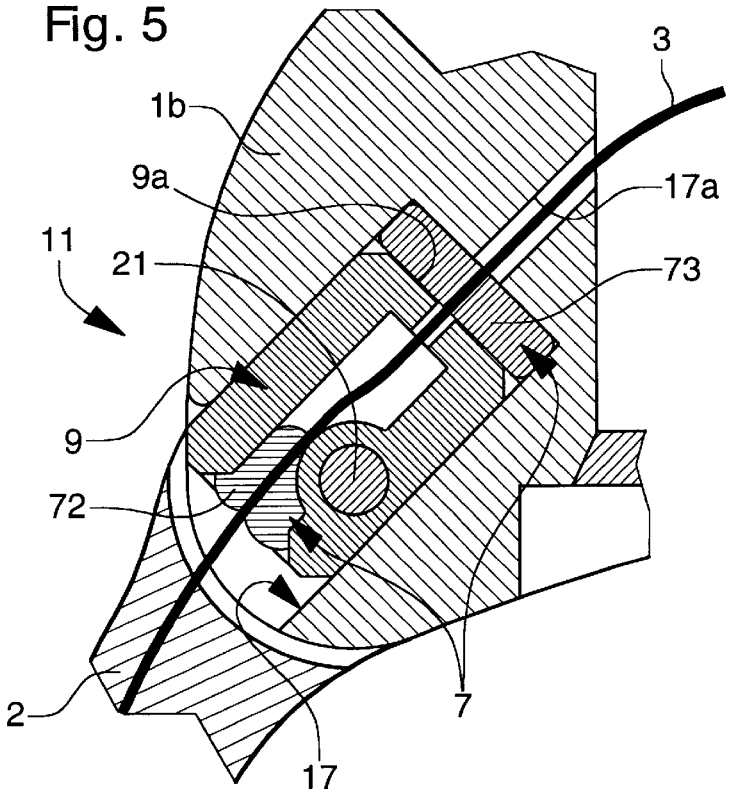
FIG. 5 is an enlarged cross-section of a watch forming a third embodiment of the present invention.

FIG. 5 shows a cross-section of a portion of a watch forming a third embodiment of the present invention. The elements common to the embodiments already presented will not be described again and are designated by the same numerical references.

According to this third embodiment, introduction orifice 17 has, in the end portion thereof which opens out into watch case 1, a portion of smaller diameter 17*a* against which the introduction means, formed in this example of an introduction element indicated by the numerical reference 9, abuts. This introduction element 9 has here a frontal surface 9*a* intended to compress a joint 73 against portion 17*a* when introduction element 9 is inserted and mounted in introduction orifice 17. Joint 73 intended to be compressed can be made by over-moulding a joint around electric connecting means 3 or alternatively by the deposition of a silicon joint.

Figure 6:
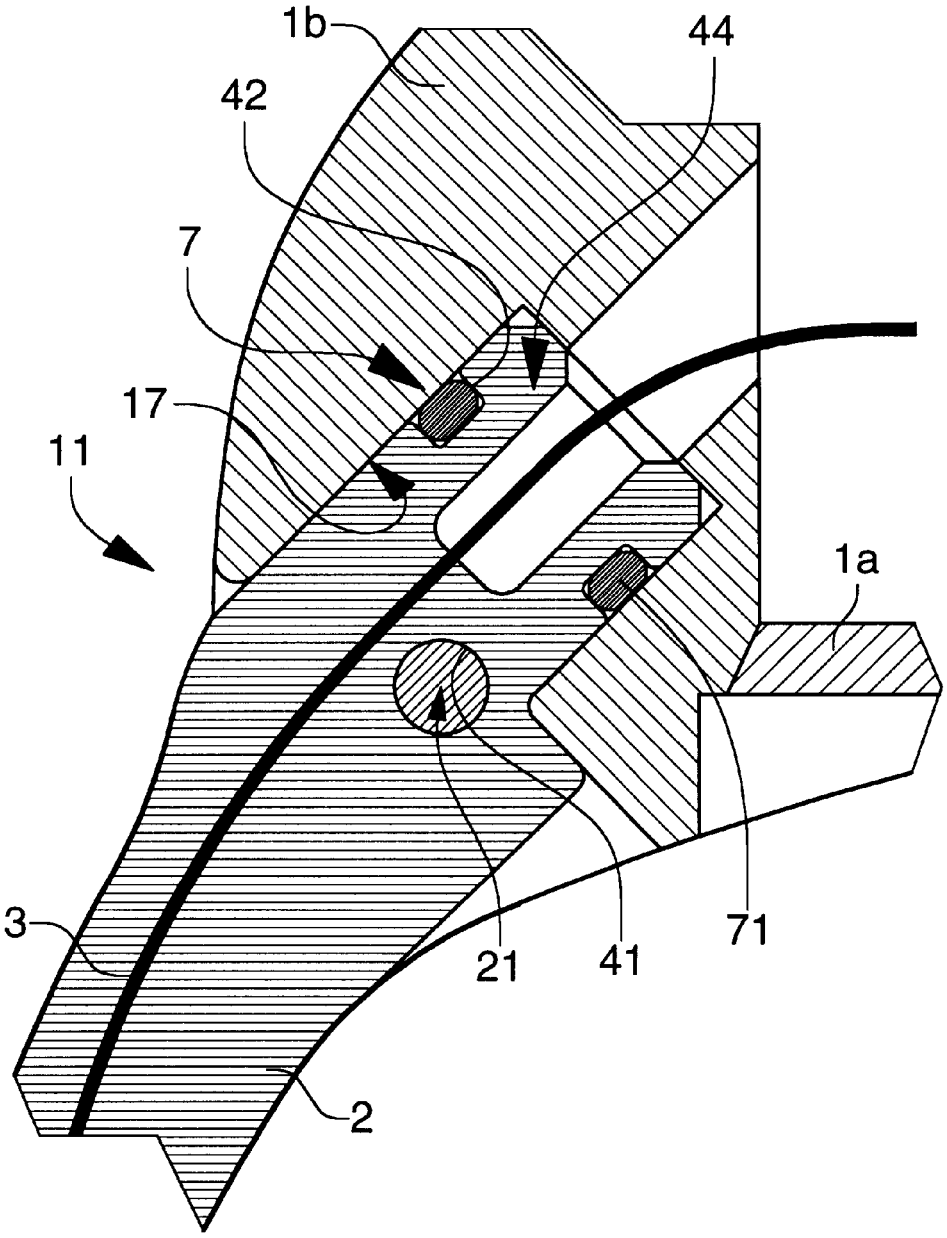
FIG. 6 is an enlarged cross-section of a watch forming a fourth embodiment of the present invention.

FIG. 6 shows a cross-section of a portion of a watch constituting a fourth embodiment of the present invention. The elements common to the embodiments already presented will not be described again and are designated by the same numerical references.

According to this fourth embodiment, the introduction means indicated in this example by the numerical reference 44 are formed of an introduction element integral with wristband 2 and thus advantageously form an integral part thereof. According to this embodiment, it is thus possible to eliminate the presence of a plug inside introduction means 44, sealing being able to be assured directly in the vicinity of the wristband. Should the occasion arise such a plug can be made from the inside of watch case 1 when the wristband and electric connecting means are assembled.

In order to assure the sealing of watch case 1 in the vicinity of introduction orifice 17, the watch includes in this example, in a similar way to the first embodiment which has already been presented, an annular joint 71 arranged in a channel 42 arranged on an outer portion of introduction element 44. It will be noted however that the sealing means presented in relation to the second and third embodiments, namely the formation of at least one bulge of material on the introduction element or of a joint compressed against a portion of the introduction orifice, are also applicable by analogy.

According to the present invention, it will be noted finally that the means for introducing the electric connecting means may advantageously be made of plastic material. In particular, according to the fourth embodiment of the present invention, introduction element 44 can thus easily be made, in the case of a plastic wristband, during manufacturing of the wristband, in particular by plastic injection moulding.

What is claimed is:

1. A watch including a watch case in which is arranged a first electric module, and a wristband attached to said watch case and with which are associated a second electric module and electric connecting means assuring an electric connection between said first and second electric modules, wherein the watch includes introduction means allowing said electric connecting means to be introduced inside the watch case in a water resistant manner, the introduction means being arranged in an introduction orifice provided in said watch case and retained by means of a pin, the watch further including sealing means assuring sealing of said introduction orifice when the introduction means are disposed therein.

2. A watch according to claim 1, wherein said introduction means are formed of an introduction element having an essentially tubular shape.

3. A watch according to claim 2, wherein said introduction means form a part of said wristband and form a single piece therewith.

4. A watch according to claim 2, wherein said sealing means include an annular joint disposed in a channel arranged on an outer portion of said introduction element.

5. A watch according to claim 2, wherein said sealing means are formed of at least one bulge of material on an outer portion of said introduction element.

6. A watch according to claim 2, wherein said sealing means are formed of at least one bulge of material on an inner portion of said introduction orifice.

7. A watch according to claim 2, wherein said sealing means include a joint compressed between said introduction element and a portion of smaller diameter of said introduction orifice.

8. A watch according to claim 7, wherein said compressed joint is formed of a joint over-molded around said electric connecting means.

9. A watch according to claim 7, wherein said compressed joint is made by the deposition of a silicon joint.

10. A watch according to claim 2, wherein said sealing means include a plug arranged inside said introduction element.

11. A watch according to claim 10, wherein said plug is made by the deposition of a silicon joint inside said introduction element after the assembly of said electric connecting means.

12. A watch according to claim 10, wherein said plug is formed of a joint over-molded around said electric connecting means.

13. A watch according to claim 2, wherein said wristband is attached to said watch case by hinges, said pin retaining said introduction element forming an articulation pin for one of said hinges.

14. A watch according to claim 1, wherein said introduction means are made of plastic material.

* * * * *